United States Patent [19]

Ohashi et al.

[11] Patent Number: 4,634,656

[45] **Date of Patent: * Jan. 6, 1987**

[54] ALUMINUM ALLOY, A SUPPORT OF LITHOGRAPHIC PRINTING PLATE AND A LITHOGRAPHIC PRINTING PLATE USING THE SAME

[75] Inventors: Azusa Ohashi; Akira Shirai; Hirokazu Sakaki, all of Shizuoka; Zenichi Tanabe; Shin Tsuchida; Yoshikatsu Hayashi, all of Aichi, Japan

[73] Assignees: Fuji Photo Film Co., Ltd., Kanagawa; Sumitomo Light Metal Industries, Ltd., Tokyo, both of Japan

[ * ] Notice: The portion of the term of this patent subsequent to Oct. 15, 2002 has been disclaimed.

[21] Appl. No.: 500,130

[22] Filed: Jun. 1, 1983

[30] Foreign Application Priority Data

Jun. 1, 1982 [JP] Japan ..... 57-92079

[51] Int. Cl.[4] ..... G03C 1/94; C22C 21/06; C25F 3/00; C25F 3/04

[52] U.S. Cl. ..... 430/278; 101/459; 148/627; 204/17; 204/33; 204/44; 204/58; 204/129.1; 204/129.4; 204/129.43; 204/129.75; 204/43.1; 204/44.4; 427/415; 420/529; 420/530; 420/531; 420/538

[58] Field of Search ..... 430/302, 275, 276, 278, 430/155, 157; 148/6.27; 101/459; 204/17, 33, 43 R, 43 S, 44, 58, 129.1, 129.4, 129.43, 129.75; 427/415

[56] References Cited

U.S. PATENT DOCUMENTS

| | | | |
|---|---|---|---|
| 3,980,539 | 9/1976 | Lloyd et al. | 204/129.1 |
| 4,008,084 | 2/1977 | Ikeda et al. | 430/278 |
| 4,229,266 | 10/1980 | Usbeck | 204/33 |
| 4,244,756 | 1/1981 | Tanabe et al. | 148/2 |
| 4,294,672 | 10/1981 | Ohba et al. | 204/129.43 |
| 4,331,479 | 5/1982 | Toyoma | 430/145 |
| 4,476,006 | 10/1984 | Ohashi et al. | 430/278 |
| 4,547,274 | 10/1985 | Ohashi et al. | 204/129.75 |

*Primary Examiner*—Charles L. Bowers, Jr.
*Attorney, Agent, or Firm*—Sughrue, Mion, Zinn, Macpeak & Seas

[57] ABSTRACT

An aluminum alloy, a lithographic printing plate support, a lithographic printing plate using the aluminum alloy are disclosed. The aluminum alloy is comprised of aluminum containing 0.20 to 1.0% Fe and 0.005 to 0.1% of elements selected from the group consisting of Sn, In, Ga and Zn. The support composed by the aluminum alloy can be chemically etched with an acid and/or an alkali solution and after undergoing etching the surface of the support is uniformly etched. The uniformly etched surface may be provided with a subbing layer or an anode oxidation film. The support is coated with a light-sensitive layer and utilized as a lithographic printing plate.

10 Claims, No Drawings

ALUMINUM ALLOY, A SUPPORT OF LITHOGRAPHIC PRINTING PLATE AND A LITHOGRAPHIC PRINTING PLATE USING THE SAME

CROSS REFERENCES

This application is related to our U.S. application entitled "Support for Lithographic Printing Plate" filed with this application and based on the disclosure contained within Japanese Patent Application No. 92080/82 filed on June 1st, 1982.

FIELD OF THE INVENTION

The present invention relates to an aluminum alloy, a lithographic printing plate support and a lithographic printing plate using the same.

BACKGROUND OF THE INVENTION

In using aluminum plates as supports for printing plates, they are usually subjected to a treatment for roughening their surfaces in order to ensure good intimate adhesion between the aluminum plate and a light-sensitive film to be provided thereon and improve water retention in non-image areas. This surface roughening treatment is called graining, and includes mechanical graining such as ball graining, sand blast graining or brush graining, electrochemical graining which is also called electrolytic polishing, and chemical etching which is called chemical graining. These conventional graining processes possess advantages and disadvantages. In general, problems with the mechanical graining process include scuff marks, stains and residue of an abrasive used. The electrochemical graining process makes it possible to change the depth of the graining as well as the form of grains by controlling the quantity of electricity. However, it requires a large quantity of electricity and a long time to create grains suited for printing plates which leads to high production costs.

On the other hand, the chemical graining process grains aluminum or aluminum alloy by a chemical etching reaction using an acid or an alkali etchant, and, hence, it is simple and suited for continuously treating aluminum or aluminum alloy strips, and is particularly advantageous for industrially producing plates having been treated on both sides.

However, it has so far been difficult to produce high quality printing plates using commercially available aluminum or aluminum alloy. Conventional chemical etching processes described in, for example, U.S. Pat. Nos. 2,344,510 and 2,714,066, have difficulty in forming a surface having enough surface roughness and uniform pit pattern (wherein etching pits have a uniform diameter and a uniform depth) to give sufficient printing durability and staining resistance required for printing plates.

According to the experiments conducted by the inventors, chemical etching of commercially available aluminum and aluminum alloy (JIS 1050, 1100 and 3003) using various etchants has been found to involve the following problems. (1) It is difficult to provide a practical surface roughness of 0.3 to 1.2 μRa (centerline average roughness) which is suitable as a printing plate and, even when such roughness is attained, the reaction rate is so slow that the process requires a long time. (2) The etchant contains ingredients harmful for workers, thus causing a problem in view of working atmosphere. (3) The etching cost is too high to be practical.

SUMMARY OF THE INVENTION

The present invention relates to an aluminum alloy, a lithographic printing plate support and a lithographic printing plate using the aluminum alloy which solve the above-described problems.

The aluminum alloy of the present invention contains 0.20 to 1.0% Fe, 0.005 to 0.1% of at least one element selected from among Sn, In, Ga and Zn, and optionally 0.1 to 2% Cu.

DETAILED DESCRIPTION OF THE INVENTION

The aluminum alloy of the present invention shows a good solution velocity for chemical etching treatment and contains an intermetallic compound capable of accelerating formation of uniform pits. Etching treatment of the plate with a popularly used acid or alkali produces uniformly and densely distributed pits on the surface of the plate.

The alloy composition in accordance with the present invention is described below.

In order to accelerate solution velocity of aluminum, it is desired to first enlarge the local cathode area as large as possible, then to use the baser local anode. For the first purpose, incorporation of much impurities is recommended. Addition of 0.20 to 1.0 wt% of Fe and, preferably, further addition of 0.1 to 2 wt% of Cu has been found to be effective. If the content of Fe and Cu are more than is described above, the anode area is reduced, resulting in formation of a non-uniform etching pit pattern. In addition, an anode oxidation film is difficult to produce on impurities, and, hence, incorporation of too much impurities would cause film defects, resulting in the formation of background stain upon printing. Alloys containing Fe and, optionally, Cu show such a large solution velocity for both acids and alkalis that a proper solution can be selected depending upon the amount of etching desired and the desired pattern.

Addition of such elements as Sn, In, Ga and Zn renders a matrix electrochemically baser, thus accelerating solution velocity. Plates containing these elements may be employed for relief printing plates disclosed in Japanese Patent Publication No. 9930/74. With relief printing plates, a pattern with a depth of several mm is required, whereas with lithographic plates the depth is several microns at most, which means that the pit pattern must be fine.

It has been surprisingly found that addition of small amounts of Sn, In, Ga or Zn series element as described above to Fe and, optionally Cu, alloys renders the resulting pit pattern extremely fine though solution velocity is not substantially influenced. These elements are added in an amount in the range of 0.005 to 0.1% and particularly if the elements Sn, In and Ga are added in amounts greater than 0.1%, the solution limit is exceeded to the extent that local dissolution becomes serious, making it difficult to form a uniform pit pattern.

The aluminum alloy of the present invention is produced by hot-rolling of a casting composition for aluminum alloy containing Al, Fe and at least one element selected from among Sn, In, Ga and Zn, and optionally Cu, at 400° C. to 600° C., and intermedium-annealing at 300° C. to 500° C. followed by cold-rolling to obtain a desired thickness. Aluminum and other contents in the alloy thus-obtained were identified using fluorescence X-ray analysis and/or emission spectroanalysis.

The printing plate support in accordance with the present invention is produced as follows. The chemical etching of the aluminum alloy is carried out using an acid or alkali such as hydrochloric acid, nitric acids, sulfuric acid, phosphoric acid, hydrofluoric acid, etc., or a mixture of two or more of these acids, and sodium hydroxide, sodium carbonate, sodium tertiary phosphate, sodium silicate, etc., are used as the alkali. Concentration and temperature of the etching solution depend upon etching time and required surface roughness but, as a general guide, the concentration ranges from 1 to 50%, the temperature from 20° C. to 90° C., and the treating time from 10 seconds to about 4 minutes. Both chemical etchings by alkali and acid may be carried out in this order or in the reverse order. Where the plate is stained, for example, with a rolling oil, a degreasing treatment is conducted prior to the chemical etching. In order to remove smut remaining on the etched surface, pickling is effected. Acids to be used for the pickling include nitric acid and sulfuric acid. The pickling reaction can be accelerated by adding hydrogen peroxide.

The thus-treated aluminum alloy plate can be used as such as a support for a lithographic printing plate. In addition, an anode oxidation film may further be provided thereon to use as a high quality lithographic printing plate support. The thickness of the anode oxidation film is preferably 0.1 to 10 g/m$^2$, more preferably 0.1 to 5 g/m$^2$.

The anodic oxidation processing can be carried out using techniques which have so far been employed in the art. Specifically, an anodically oxidized film can be formed on the surfaces of an aluminum support by passing DC or AC current to the aluminum support in an aqueous solution containing sulfuric acid, phosphoric acid, oxalic acid, or a mixture of two or more of these acids.

Processing conditions of anodic oxidation are changed depending upon what kind of electrolytic solution is used and, therefore, they cannot be determined indiscriminately. However, as a general guide, it can be said that an electrolytic solution having a concentration of 1 to 80 wt%, a solution temperature of 5° to 70° C., a current density of 0.5 to 60 ampere/dm$^2$, a voltage applied of 1 to 100 v and an electrolyzing time of 10 to 100 seconds can produce a preferable result.

Particularly effective anodically oxidized film forming processes are the processes used in British Pat. No. 1,412,768, wherein anodic oxidation is carried out in sulfuric acid by sending a high density electric current, and the process described in U.S. Pat. No. 3,511,661 (incorporated herein by reference to disclose such a film forming process), wherein anodic oxidation is carried out using phosphoric acid as an electrolytic bath.

The aluminum plate which has been anodically oxidized may be further treated with an aqueous solution of an alkali metal silicate such as sodium silicate or the like using a conventional technique, e.g., a dipping technique, as described in U.S. Pat. Nos. 2,714,066 and 3,181,461 (incorporated herein by reference to disclose such techniques). Alternatively, a subbing layer made up of hydrophilic cellulose (e.g., carboxymethyl cellulose, etc.) containing a water-soluble metal salt (e.g., zinc acetate, etc.) may be additionally provided in a preferable thickness of 0.001 to 1 g/m$^2$, more preferable thickness of 0.005 to 0.5 g/m$^2$, on the anodically oxidized aluminum plate, as described in U.S. Pat. No. 3,860,426 (incorporated herein by reference to disclose how to provide a subbing layer).

On the lithographic printing plate support prepared in accordance with an embodiment of the present invention, a light-sensitive layer which is known to have been used for presentitized plates is provided to produce a light-sensitive lithographic printing plate. The lithographic printing plate obtained by subjecting this presensitized plate to a plate making process has excellent properties.

Suitable examples of the composition of the above-described light-sensitive layer are described below.

(1) Light-sensitive layer comprised of a diazo resin and a binder:

Preferred examples of the diazo resin include those described in U.S. Pat. Nos. 2,063,631, 2,667,415, Japanese Patent Publication Nos. 18001/74, 45322/74, 45323/74 and British Pat. Nos. 1,312,925 and 1,023,589. Preferred examples of the binder include those described in British Pat. Nos. 1,350,521 and 1,460,978, U.S. Pat. Nos. 4,123,276, 3,751,257, and 3,660,097, and Japanese Patent Application (OPI) No. 98614/79 (the term "OPI" as used herein refers to a "published unexamined Japanese patent application").

(2) Light-sensitive layer comprised of an o-quinonediazide compound:

Particularly preferable examples of the o-quinonediazide compound include o-naphthoquinonediazide compounds as described in U.S. Pat. Nos. 2,766,118, 2,767,092, 2,772,972, 2,859,112, 2,907,665, 3,046,110, 3,046,111, 3,046,115, 3,046,118, 3,046,119, 3,046,120, 3,046,121, 3,046,122, 3,046,123, 3,061,430, 3,102,809, 3,106,465, 3,635,709 and 3,647,443 and many other publications.

(3) Light-sensitive layer comprised of a composition containing an azide compound and a binder (macromolecular compound):

Specific examples of the composition include compositions comprised of azide compounds and water-soluble or alkali-soluble macromolecular compounds which are described in British Pat. Nos. 1,235,281 and 1,495,861, Japanese Patent Application (OPI) Nos. 32331/76 and 36128/76, and so on, and compositions comprised of azido group-containing polymers and macromolecular compounds as binders, as described in Japanese Patent Application (OPI) Nos. 5102/75, 84302/75, 84303/75, and 12984/78.

(4) Light-sensitive layers comprised of other light-sensitive resinous compositions:

Specific examples include the polyester compounds disclosed in Japanese Patent Application (OPI) No. 96696/77, polyvinyl cinnamate series resins described in British Pat. Nos. 1,112,277, 1,313,390, 1,341,004 and 1,377,747 and photopolymerizable photopolymer compositions described in U.S. Pat. Nos. 4,072,528 and 4,072,527, and so on.

The amount (thickness) of the light-sensitive layer to be provided on the support is controlled to about 0.1 to about 7 g/m$^2$, preferably 0.5 to 4 g/m$^2$.

Lithographic printing plates, after imagewise exposure, are subjected to processings including a developing step in a conventional manner to form resin images. For instance, a lithographic printing plate having the light-sensitive layer (1) constituted with a diazo resin and a binder has unexposed portions of the light-sensitive layer removed by development after imagewise exposure to produce a lithographic printing plate. On the other hand, a lithographic printing plate having a light-sensitive layer (2) has exposed portions of the light-sensitive layer which are removed by development with an alkaline aqueous solution after imagewise exposure to produce a lithographic printing plate.

The present invention will now be described in more detail by reference to the following examples. However, the scope of the invention is not limited to these examples.

Unless otherwise stated, all percents(%) are by weight in the above description and in the following examples.

EXAMPLE 1

A casting composition containing 99.26% of Al, 0.70% of Fe and 0.40% of Sn was subjected to hot-rolling, which temperature was 500° C., and then to intermedium-annealing at 400° C. followed by cold-rolling. The aluminum alloy plate thus-obtained had 0.30 mm of thickness. The alloy was confirmed to contain 99.26% of Al, 0.70% of Fe and 0.04% of Sn by a fluorescence X-ray analysis using X-ray.

EXAMPLE 2

The following 8 aluminum alloy plates were prepared and subjected to a chemical graining treatment for 1 minute at 60° C. in 10% NaOH. Surface roughness of the thus-treated plates was measured, and the pit pattern was observed under a scanning electron microscope (SEM).

TABLE 1

| No. | Alloy Composition (% by weight) | | | | | |
|---|---|---|---|---|---|---|
| | Fe | Cu | Sn | In | Ga | Zn |
| 1 | 0.70 | 0.50 | 0.04 | — | — | — |
| 2 | 0.70 | 0.50 | — | 0.06 | — | — |
| 3 | 0.70 | 0.30 | — | — | 0.03 | — |
| 4 | 0.70 | 0.50 | 0.05 | — | — | 0.20 |
| 5 | 0.30 | 0.60 | 0.04 | — | — | — |
| 6 | 0.70 | — | 0.04 | — | — | — |
| Comparative Example 1 | 0.70 | 0.50 | — | — | — | — |
| Comparative Example 2 | 0.10 | — | 0.05 | — | — | — |

*In the alloy composition, the remainder is a present of Al.

TABLE 2

| No. | Properties of Chemically Grained Surface Etching in NaOH Solution | |
|---|---|---|
| | Surface Roughness (Ra) | Pit Pattern |
| 1 | 0.35 | Uniform, uniform pits of 2–8μ |
| 2 | 0.33 | " |
| 3 | 0.30 | " |
| 4 | 0.37 | " |
| 5 | 0.37 | " |
| 6 | 0.34 | " |
| Comparative Example 1 | 0.34 | Non-uniform, coarse pits of 7–15μ |
| Comparative Example 2 | 0.19 | Uniform, uniform pits of 2–8μ |

As is clear from Table 2, Comparative Sample 1 not containing Sn, In, Ga and Zn formed coarse pits, and Comparative Sample 2 containing a less amount of Fe had a low surface roughness.

EXAMPLE 3

Sample No. 1 and Comparative Samples 1 and 2, shown in Example 2, were subjected to a first chemical graining treatment in 10% sodium hydroxide at 60° C. for 1 to 5 minutes, then to a second chemical graining treatment in an aqueous mixture solution of 300 ml/l nitric acid and 150 ml/l sulfuric acid at 90° C. for 3 minutes, followed by observation under SEM and measurement of surface roughness.

TABLE 4

| Sample | Properties of Samples Subjected to Two-Stage Graining Treatments | | |
|---|---|---|---|
| | Time for First Treatment (min) | Surface Roughness (μRa) | Pit Pattern |
| 1-A | 1 | 0.40 | Uniform, mixed pattern of 2–8μ pits and 0.1–0.3μ pits |
| 1-B | 2 | 0.45 | Uniform, mixed pattern of 2–8μ pits and 0.1–0.3μ pits |
| 1-C | 3 | 0.51 | Uniform, mixed pattern of 2–8μ pits and 0.1–0.3μ pits |
| 1-D | 4 | 0.53 | Uniform, mixed pattern of 2–8μ pits and 0.1–0.3μ pits |
| 1-E | 5 | 0.59 | Uniform, mixed pattern of 2–8μ pits and 0.1–0.3μ pits |
| Comparative Example 1-E | 5 | 0.57 | Non-uniform, 10–19μ coarse pits |
| Comparative Example 2-E | 5 | 0.73 | Uniform |

A plane with a large surface roughness was formed on Sample 1 due to its large solution quantity for both acid and alkali. In addition, Sample 1 had a multi pit pattern wherein uniform 1 to 5μ pits were formed with acid in uniform 2μ to 8μ pits having been formed with alkali.

EXAMPLE 4

Sample No. 1 described in Example 2, Comparative Samples 1 and 2, and Sample 1-E having been subjected to two-stage graining treatments in Example 3 were anodized in an electrolytic solution containing 20% sulfuric acid as a major component at a bath temperature of 30° C. to provide thereon a 3 g/m$^2$ oxide film, then dipped in a 2.5% aqueous solution of sodium silicate (JIS No. 3) at 60° C. for 1 minute, washed thoroughly with water, and dried.

The thus-treated samples prepared from Sample No. 1, Comparative Samples 1 and 2, and Sample 1-E were referred to as Samples A, B, C and D, respectively. On each of the thus-prepared samples was coated the following solution (I) in a dry thickness of 2.0 g/m$^2$ to prepare lithographic printing plates.

| Solution (I): | |
|---|---|
| 2-Hydroxyethyl methacrylate copolymer (synthesized according to the process described in Example 1 of British Patent 1,505,739) | 0.7 g |
| 2-Methoxy-4-hydroxy-5-benzoylbenzene-sulfonate of a condensate between p-diazodiphenylamine and paraformaldehyde | 0.1 g |
| Oil Blue #603 (product of Orient Chemical Co., Ltd.) | 0.03 g |
| 2-Methoxyethanol | 6 g |
| Methanol | 6 g |
| Ethylenedichloride | 6 g |

Thus thus-obtained light-sensitive lithographic printing plates were each imagewise exposed for 70 seconds by means of a metal halide lamp of 3 kw placed at a distance of 1 meter, and dipped in the following developing solution for 1 minute at room temperature. Then, the surface of each plate was lightly rubbed by an absorbent wadding to remove unexposed areas, thus printing plates (A), (B), (C) and (D) were obtained, respectively.

| Formulation of Developing Solution: | |
|---|---|
| Sodium sulfite | 3 g |
| Benzyl alcohol | 30 g |
| Triethanolamine | 20 g |
| Monoethanolamine | 5 g |
| Pelex NBL (sodium t-butylnaphthalene-sulfonate; product of Kao Atlas Co., Ltd.) | 30 g |
| Water | 1,000 ml |

Printing was then conducted in a conventional manner to obtain the results tabulated in Table 5.

TABLE 5

| | Sample | | | |
|---|---|---|---|---|
| Support | (A) No. 1 in Example 2 | (B) Comparative Example 1 | (C) Comparative Example 2 | (D) No. 1-E in Example 3 |
| Surface roughness (Ra) | 0.35μ | 0.34μ | 0.19μ | 0.51μ |
| Degree of uniformity of pits | Uniform, 2–8μ pits | Coarse, 7–15μ pits (non-uniform) | Uniform, 2–8μ pits | Mixture pattern of uniform 2–8μ pits and 1–5μ pits |
| Printing durability | 80,000 | 50,000 | 20,000 | 100,000 |
| Staining resistance | Excellent | Fair | Excellent | Excellent |

As is apparent from the results of the above Table 5, aluminum alloy support for the lithographic printing plate of the present invention provides a sufficient printing durability and staining resistance.

While the invention has been described in detail and with reference to specific embodiments thereof, it will be apparent to one skilled in the art that various changes and modifications can be made therein without departing from the spirit and the scope thereof.

What is claimed is:

1. An aluminum alloy lithographic printing plate, comprising:

a printing plate support comprised of a plate of an aluminum alloy containing 0.20 to 1.0% by weight of Fe; 0.005 to 0.1% by weight of at least one element selected from the group consisting of Sn, In and Ga; and the remainder being Al, based on the total weight of said aluminum alloy;

the support having a chemically etched surface, which is etched so as to form a uniform grain structure; and a light-sensitive layer provided on the chemically etched surface of said support.

2. An aluminum alloy lithographic printing plate as claimed in claim 1, wherein the support surface is chemically etched with an acid or an alkali.

3. An aluminum alloy lithographic printing plate as claimed in claim 1, wherein the support surface is chemically etched with an etching solution of an acid selected from the group consisting of hydrochloric acid, nitric acid, sulfuric acid, phosphoric acid and hydrochloric acid or an etching solution of an alkali selected from the group consisting of sodium hydroxide, sodium carbonate, sodium tertiary phosphate and sodium silicate.

4. An aluminum alloy lithographic printing plate support, comprising a plate of an aluminum alloy containing 0.20 to 1.0% by weight of Fe; 0.005 to 0.1% by weight of at least one element selected from the group consisting of Sn, In and Ga; and the remainder being Al, based on the total weight of said aluminum alloy, wherein a surface of the support is chemically etched to form a uniform grain structure.

5. An aluminum alloy lithographic printing plate support as claimed in claim 4, further comprising 0.1 to 2% by weight Cu.

6. An aluminum alloy lithographic printing plate support as claimed in claim 4, wherein the surface is chemically etched with an etching solution of an acid selected from the group of acids consisting of hydrochloric acid, nitric acid, sulfuric acid, phosphoric acid, and hydrochloric acid or an alkali solution selected from the group of alkalis consisting of sodium hydroxide, sodium carbonate, sodium tertiary phosphate and sodium silicate.

7. An aluminum alloy lithographic printing plate support as claimed in claim 4, wherein the chemically etched surface of the support has an anode oxdiation film provided thereon by anodic oxidation treatment in an aqueous solution containing sulfuric acid, phosphoric acid, oxalic acid, or a mixture of two of these acids using DC or AC current.

8. An aluminum alloy lithographic printing plate support as claimed in claim 4, wherein the surface has provided thereon a subbing layer.

9. An aluminum alloy lithographic printing plate support as claimed in claim 8, wherein the subbing layer is comprised of a hydrophilic cellulose containing a water-soluble metal salt.

10. An aluminum alloy lithographic printing plate support as claimed in claim 7, wherein the chemical etching is carried out with an acid or an alkali.

* * * * *